US005597331A

United States Patent [19]

Gable et al.

[11] Patent Number: 5,597,331

[45] Date of Patent: Jan. 28, 1997

[54] BATTERY CONNECTOR FOR AN AUTOMOTIVE ELECTRICAL SYSTEM

[75] Inventors: Patricia A. Gable, Ypsilanti; David J. Shroat, Canton; Jeffrey A. Stone, Lathrup Village, all of Mich.

[73] Assignee: Ford Motor Company, Dearborn, Mich.

[21] Appl. No.: 605,825

[22] Filed: Feb. 23, 1996

[51] Int. Cl.[6] ..... H01R 4/28

[52] U.S. Cl. ..... 439/754; 439/763; 439/504

[58] Field of Search ..... 439/754, 504, 439/756, 761, 763, 764, 189

[56] References Cited

U.S. PATENT DOCUMENTS

| | | | |
|---|---|---|---|
| Re. 26,486 | 9/1960 | Haegert | 439/763 |
| 4,473,264 | 9/1984 | Julian et al. | 439/135 |
| 4,932,896 | 6/1990 | Julian | 439/504 |
| 4,934,958 | 6/1990 | Julian | 439/504 |
| 4,938,706 | 7/1990 | Sykes | 439/202 |
| 5,171,169 | 12/1992 | Butcher et al. | 439/755 |
| 5,221,219 | 6/1993 | Thomson | 439/762 |
| 5,295,860 | 3/1994 | Jozefczyk et al. | 439/503 |

*Primary Examiner*—P. Austin Bradley
*Assistant Examiner*—T. C. Patel
*Attorney, Agent, or Firm*—Neil P. Ferraro

[57] ABSTRACT

A battery connector assembly for an automotive electrical system. The battery connector assembly includes a clamp portion joined to an electrically conductive body member at one end thereof and a stud portion joined to the body member at another end thereof. A pinchbolt and fastener is used to secure the clamp portion to a battery terminal post of a first battery. A transfer terminal is electrically connected to a second battery and is also removably connected to the stud portion. When both the battery connector assembly is connected to the terminal post of the first battery, and the transfer terminal is connected to the stud portion, the fastener used to clamp the clamp portion to the terminal post is obstructed from access. The result is that removing the clamp portion from the first battery is inhibited without first removing the transfer terminal.

20 Claims, 3 Drawing Sheets

BATTERY CONNECTOR FOR AN AUTOMOTIVE ELECTRICAL SYSTEM

FIELD OF THE INVENTION

The present invention relates to a battery connector, and more particularly, to a battery connector for an automotive electrical system for connecting two batteries.

BACKGROUND OF THE INVENTION

In an effort to supply increased electrical energy to an electrical system of a diesel engine powered vehicle, a high-current battery is required. However, in systems where there are packaging concerns, a large single battery is not feasible. As such, automotive engineers typically have employed two batteries. The first battery is usually located in the engine compartment whereas the second battery is located in a remote area. An electrical conductor transmits power from the second battery to the first battery where connection to the electrical system of the vehicle may be made.

In prior art devices, a connector is provided which connects to the first battery and which also receives the conductor from the second battery. Power from the two batteries is then supplied to the vehicle electrical system. The inventors of the present invention have recognized a disadvantage with this approach in that when the battery connector is removed from the first battery, power to the battery connector is still supplied by the second battery. If a service technician inadvertently places the connector on the vehicle chassis, an electrical short may occur.

SUMMARY OF THE INVENTION

An object of the present invention is to provide a battery connector where access to the first battery connection point is rendered more difficult in the event that the second battery connection is not first removed.

The above object is achieved, and problems of prior art approaches overcome, by providing a novel battery connector assembly for a vehicle electrical system. In one particular aspect of the invention, the battery connector assembly includes an electrically conductive body member, a first connection portion joined to the body for removable electrical connection to a terminal of a first battery and a second connection portion joined to the body for providing an electrically conductive terminal connection point for a second battery. A transfer terminal is electrically connected to the second battery and is also removably connected to the second connection portion of the battery connector. A means for securing the first connection portion of the battery connector to the first battery terminal is provided. The securing means is obstructed from access when both the first connection portion is connected to the first battery and the transfer terminal is connected to the second connection portion.

In a preferred embodiment, the battery connector assembly further includes an electrically insulating cover sealingly engaging the transfer terminal. The assembly also includes an electrically insulating member to cover the battery connector. A portion of the transfer terminal is also electrically insulated to sealingly engage the insulating member when the transfer terminal is connected to the battery connector.

An advantage of the above aspect of the invention is that power from two batteries is provided to a vehicle electrical system.

Another advantage of the above aspect of the invention is that removing the first battery connection is inhibited without first removing the second battery connection.

Yet another advantage of the present invention is that the battery connector is electrically insulated.

Still another advantage of the above aspect of the invention is that access to the battery connector is maintained so as to provide a clamp point for a battery jumper cable.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
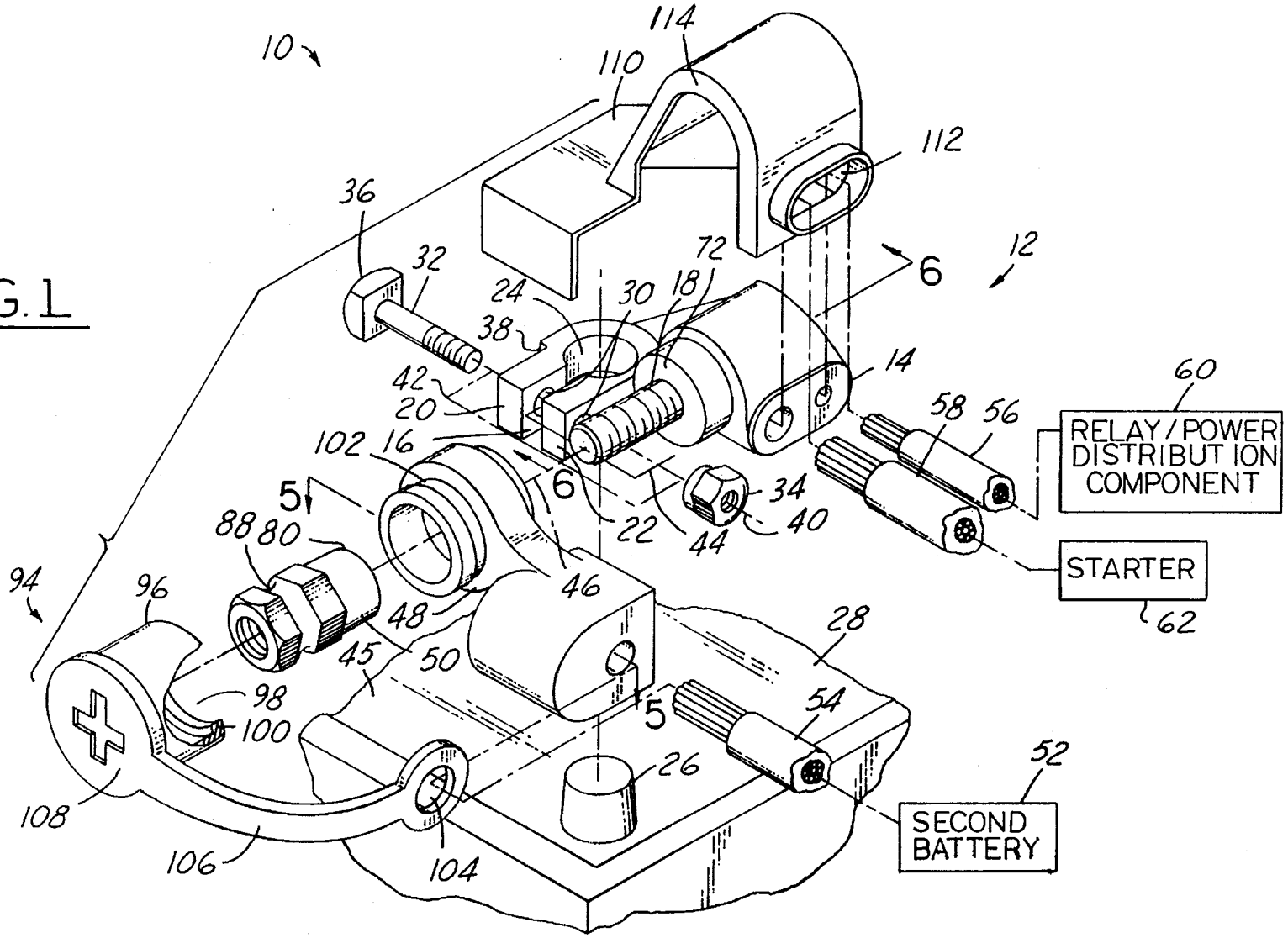
FIG. 1 is a diagrammatic exploded perspective view of a battery connector assembly according to the present invention.

Beginning with FIG. 1, electrical system 10 of an automotive vehicle having battery connector assembly 12 is shown. Battery connector assembly 12 has body portion 14, which is formed of a molded metal such as lead alloy, first connection portion (clamp portion) 16 joined to body member 14 and second connection portion (threaded stud portion) 18 also joined to body member 14 for providing a terminal connection point. Clamp portion 16 is generally U-shaped with spaced opposing sides 20 and 22 forming an opening 24 therebetween configured to receive terminal post 26 of first battery 28. Pinchbolt 32 extends through aligned bolt apertures 30 in sides 20 and 22 and threadingly engages fastener 34 so that sides 20 and 22 can be drawn together to reduce the size of opening 24 and thereby secure clamp portion 16 about battery post 26. Pinchbolt 32 has a square head 36 that engages the shoulder 38 of clamp portion 16 so that when pinchbolt 32 extends along axis 40 through apertures 30, head 36 engages shoulder 38 to prevent rotation about axis 40. In a preferred embodiment, the threads of pinchbolt 34 are staked so as to inhibit complete removal of fastener 34 from pinchbolt 32 once fastener 34 is threaded onto pinchbolt 32.

Clamp portion 16 lies in a plane 42 at one end of body member 14. Stud portion 18 is located in plane 44, spaced from and superimposed on plane 42, at another end of body 14. Planes 42 and 44 are parallel to face 45 of first battery 28 when clamp portion 16 is installed on post 26. Stud portion 18 has axis 46 such that axis 46 and axis 40 of pinchbolt 32 are substantially perpendicular to each other.

Battery connector assembly 12 further includes transfer terminal 48, which is removably connected to threaded stud portion 18 via terminal fastener 50, which threadingly engages stud portion 18. Transfer terminal 48 is electrically connected to second battery 52 by conductor 54. Power is thus supplied to battery connector assembly 12 from second battery 52.

Figure 2:
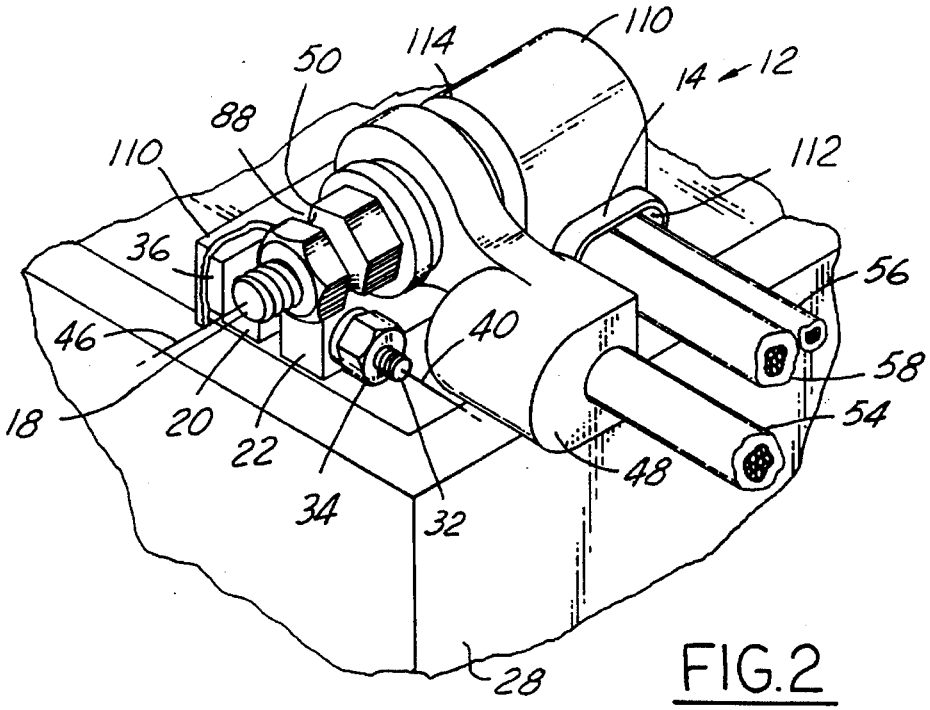
FIG. 2 is a diagrammatic perspective view of the battery connector assembly.
Figure 3:
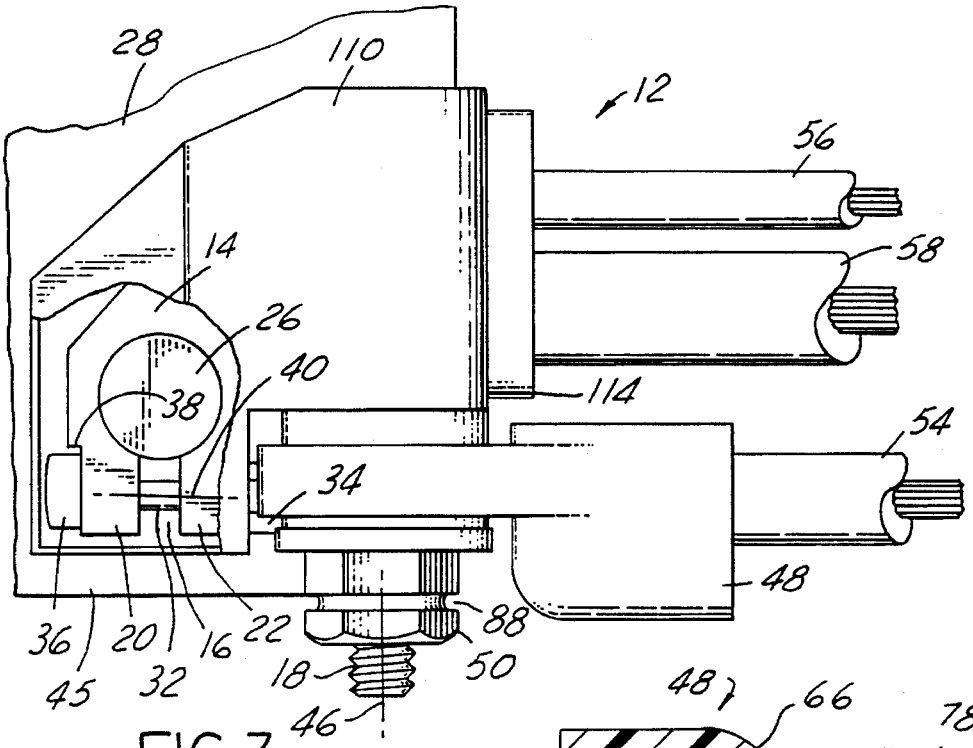
FIG. 3 is a top plan view of the battery connector assembly.
Figure 4:
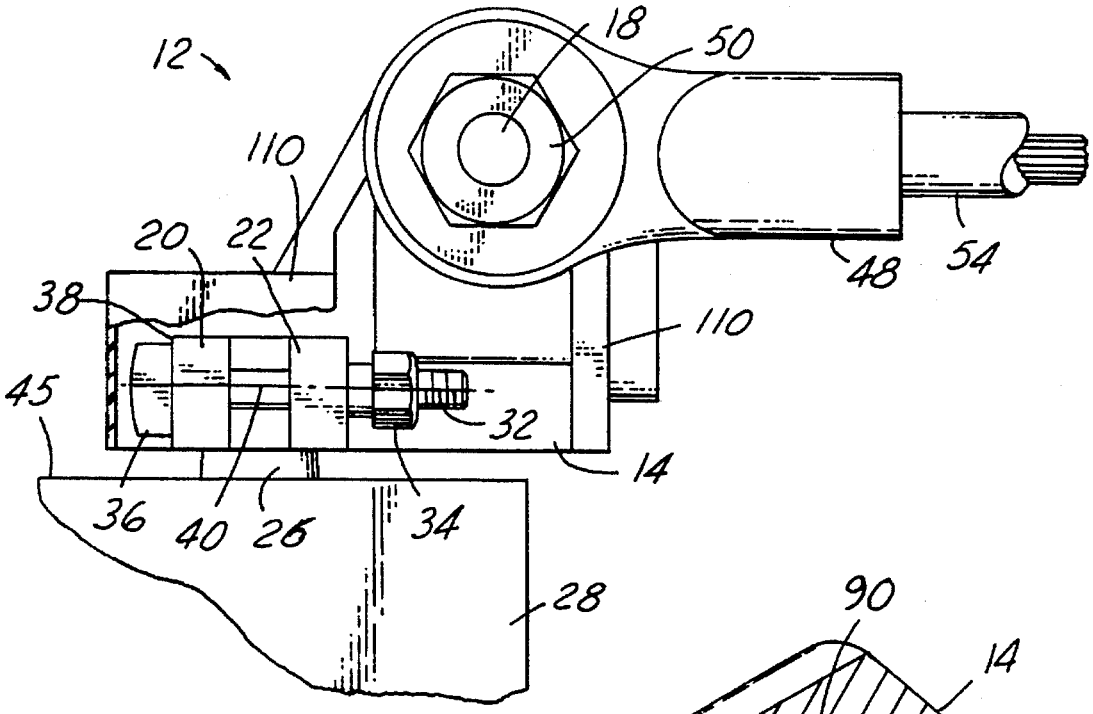
FIG. 4 is a front plan view of the battery connector assembly.

When assembled, as best shown in FIGS. 2–4, which represent assembled perspective, top plan and front plan views, respectively, of battery connector assembly 12, access to fastener 34 is obstructed or restricted when transfer terminal 48 is connected to stud 18. Thus, according to the present invention, removing battery connector assembly 12 from battery post 26 is inhibited without first removing transfer terminal 48. As used in this specification and the attached claims, "superimposed" shall be construed to mean planes 42 and 44 overlaying one another such that removing battery connector assembly 12 from first battery 28 is inhibited without first removing transfer terminal 48.

Electrical system 10, as shown in FIG. 1, further includes electrical conductors 56 and 58 electrically joined to body member 14 of battery connector 12 for transmitting electrical energy to electrical components such as relay/power distribution component 60 and starter 62 respectively, of the vehicle. Connection to body member 14 may be made by any conventional connection methods including, but not limited to, soldering, bolting or crimping. Thus, according to the present invention, electrical energy from both first 28 and second 52 batteries may be transmitted to a plurality of electrical components of the vehicle.

Battery connector assembly 12 further includes insulating member 110 formed to cover both clamp portion 16 and body member 14. Insulating member 110 may have an opening 112 so as to provide access to body member 14 for cables 56 and 58.

Figure 5:
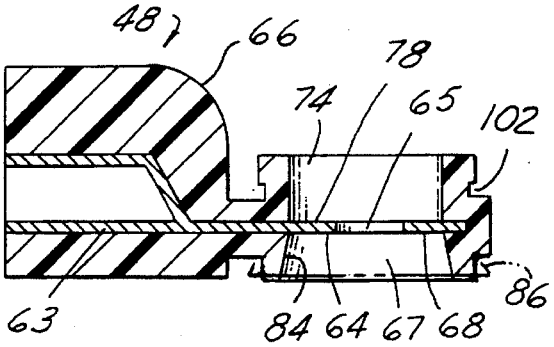
FIG. 5 is a cross-sectional view of a transfer terminal of the battery connector assembly; and, FIG. 6 is a partial cross-sectional perspective view of a stud portion of the battery connector assembly.

Referring now to FIG. 5, transfer terminal 48 includes body 63, configured to receive conductor 54, and tongue 64, having hole 65 for attachment to stud 18. In a preferred embodiment, transfer terminal 48 is at least partially electrically insulated by insulating cover 66 formed around terminal body 63 and tongue 64 by any acceptable manufacturing method including, but not limited to, injection molding. Opening 67 of insulating cover 66 provides access to tongue 64 such that face 68 can make electrical contact with shoulder 72 of battery connector assembly 12 (see FIG. 1). Insulating cover 66 further includes opening 74 such that face 78 can make electrical contact with bearing surface 80 of terminal fastener 50 (see FIG. 1). As a result, terminal fastener 50 makes electrical contact with transfer terminal 48. Also, in a preferred embodiment, opening 67 has sidewall 84 shaped as a frusto-conical surface. Thus, as terminal fastener 50 is tightened about stud portion 18, sidewall 84 collapses as shown in phantom line 86 to sealingly engage insulating member 110 at surface 114.

As previously stated, face 78 of tongue 68 electrically contacts bearing surface 80 of terminal fastener 50. Terminal fastener 50 may thus be used for attachment of a clamp of a jumper cable. To further facilitate attachment of the jumper cable clamp, angular groove 88 is provided in terminal fastener 50 (see FIGS. 1–3). Groove 88 reduces the likelihood of the clamp of the jumper cable from inadvertently disengaging.

Continuing with FIG. 1, battery connector 12 further includes electrically insulating cover 94 for electrically insulating terminal fastener 50 and stud portion 18 when assembled. Cover 94 is generally a cylindrical member having sidewalls 96, and bore 98. Bore 98 is sized to engage terminal fastener 50 in a slight interference fit. To further enhance the holding ability of cover 94, annular locking tab 100, located on the inner circumference of bore 98, engages annular recess 102 molded into insulating cover 66 of transfer terminal 48 (see also FIG. 5).

Cover 94 may be tethered to conductor 54. Thus, conductor 54 passes through opening 104 in tether strap 106. In a preferred embodiment, cover 94 is color coded red and is embossed with "+" sign 108 to alert an operator that cover 94 insulates a positive battery terminal connection point.

Figure 6:
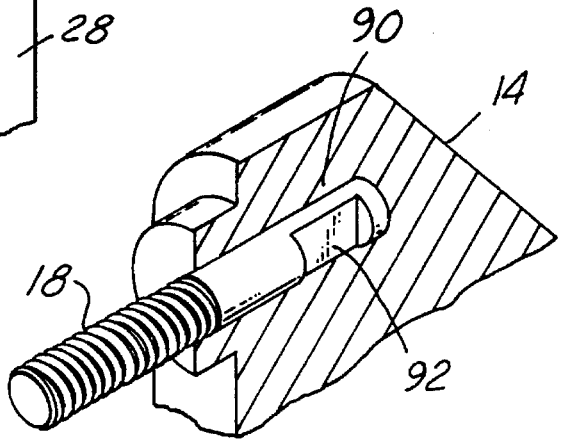

Turning now to FIG. 6, because member 14 is made of a molded metal such as lead alloy, whereas stud 18, in order to provide a secure fastening means, is typically made out of a harder material such as steel, stud 18 has keyed section 90 for preventing rotation of stud 18 relative to body member 14. As the lead alloy of body member 14 is molded around stud 18, the molten material flows around flats 92 of keyed section 90 (one flat 92 is shown in FIG. 6) to effectively prevent the rotation.

While the best mode in carrying out the invention has been described in detail, those having ordinary skill in the art in which this invention relates will recognize various alternative designs and embodiments, including those mentioned above, in practicing the invention that have been defined by the following claims.

We claim:

1. A battery connector assembly comprising:

an electrically conductive body member;

a first connection portion joined to said body for removable electrical connection to a terminal of a first battery;

a second connection portion joined to said body for providing an electrically conductive terminal connection point for a second battery;

a transfer terminal electrically connected to the second battery, said transfer terminal being removably connected to said second connection portion; and, a securing means for securing said first connection portion to the first battery terminal, said securing means being obstructed from access when both said first connection portion is connected to the first battery and said transfer terminal is connected to said second connection portion.

2. A battery connector assembly according to claim 1 wherein said first connection portion comprises a clamp portion lying in a plane at one end of said body member, with said plane being parallel to a face of the first battery when said clamp portion is connected to the first battery, said clamp portion having a post opening configured to receive a terminal post of the first battery.

3. A battery connector assembly according to claim 2 wherein said securing means comprises:

a pinchbolt for securing said clamp portion to the battery terminal post, said pinchbolt defining an axis and being secured with said clamp portion to prevent rotation; and, a fastener engaging said pinchbolt.

4. A battery connector assembly according to claim 3 wherein said second connection portion comprises a stud portion defining an axis and lying in a plane at another end of said body member, said stud portion plane being spaced from and superimposed on said clamp portion plane.

5. A battery connector assembly according to claim 4 wherein said stud axis and said pinchbolt axis are substantially perpendicular to each other.

6. A battery connector assembly according to claim 4 further comprising a terminal fastener engaging said stud portion for securing said transfer terminal to said stud portion, said fastener providing a means for receiving a clamp of a jumper cable.

7. A battery connector assembly according to claim 6 further comprising an electrically insulating cover sealingly engaging said transfer terminal so as to electrically insulate said terminal fastener and said stud.

8. A battery connector assembly according to claim 1 further comprising an electrically insulating member covering said body member and said first connection portion.

9. A battery connector assembly according to claim 8 wherein a portion of said transfer terminal is electrically insulated, said insulation sealingly engages said insulating member when said transfer terminal is connected to said stud portion.

10. A battery connector assembly according to claim 1 wherein said body member is formed of molded metal.

11. A battery connector assembly according to claim 4 wherein said stud portion comprises a keyed section for preventing rotation of said stud portion relative to said body member.

12. A battery post connector assembly comprising:

a molded metal body member;

a clamp portion joined to said body member for removable electrical connection to a terminal post of a first battery, said clamp portion lying in a plane at one end of said body member, with said plane being parallel to a face of the first battery when said clamp portion is connected to the first battery, said clamp portion having a post opening configured to receive the terminal post of the first battery;

a pinchbolt for securing said clamp portion to the terminal post, said pinchbolt defining an axis and being secured within said clamp portion to prevent rotation;

a fastener engaging said pinchbolt;

a stud portion joined to said body member for providing an electrically conductive terminal connection point for a second battery, said stud portion defining an axis and lying in a plane at another end of said body member, said stud portion plane being spaced from and superimposed on said clamp portion plane, said stud axis and said pinchbolt axis are substantially perpendicular to each other, said stud portion further having a keyed section for preventing rotation of said stud portion relative to said body member;

a transfer terminal electrically connected to the second battery, said transfer terminal being removably connected to said stud portion;

a terminal fastener engaging said stud portion for securing said transfer terminal to said stud portion such that access to said fastener engaging said pinchbolt is obstructed when both said clamp portion is attached to the first battery terminal post and said transfer terminal is attached to said stud portion.

13. A battery post connector assembly according to claim 12 further comprising:

an electrically insulating cover sealingly engaging said transfer terminal so as to electrically insulate said transfer terminal fastener and said stud;

an electrically insulating member covering said body member and said clamp portion; and, an electrically insulating member partially covering said transfer terminal so as to sealingly engage said insulating member covering said body member when said transfer terminal is connected to said stud portion.

14. An electrical system for an automotive vehicle comprising:

a first battery system including;

a first battery having a battery terminal for providing a first source of electrical energy to said vehicle;

a battery connector electrically connected to said first battery including:

i) an electrically conductive body member;

ii) a first connection portion joined to said body for removable electrical connection to said terminal of said first battery;

iii) a second connection portion joined to said body for providing an electrically conductive terminal connection point; and, iv) a securing means for securing said first connection portion to said terminal of said first battery; and a second battery system electrically connected to said first battery system including:

i) a second battery;

ii) an electrical conductor connected to said second battery at one end thereof;

iii) a transfer terminal electrically connected to said conductor at another end thereof and being connected to said second connection portion of said battery connector, with said securing means being obstructed from access when both said first connection portion of said battery connector is connected to said first battery and when said transfer terminal is connected to said second connection portion of said battery connector.

15. A system according to claim 14 further comprising at least one electrical conductor connected to said body member of said battery connector for transmitting energy to at least one electrical component of said vehicle from both said first and said second batteries.

16. A system according to claim 14 wherein said first connection portion comprises a clamp portion lying in a plane at one end of said body member, with said plane being parallel to a face of said first battery when said clamp portion is connected to said first battery, said clamp portion having a post opening configured to receive a terminal post of the first battery.

17. A system according to claim 16 wherein said securing means comprises:

a pinchbolt for securing said clamp portion to said battery terminal post, said pinchbolt defining an axis and being secured within said clamp portion to prevent rotation; and, a fastener engaging said pinchbolt.

18. A system according to claim 17 wherein said second connection portion comprises a stud portion defining an axis and lying in a plane at another end of said body member, said stud portion plane being spaced from and superimposed on said clamp portion plane.

19. A system according to claim 18 wherein said stud axis and said pinchbolt axis are substantially perpendicular to each other.

20. A system according to claim 18 further comprising a fastener engaging said stud portion for securing said transfer terminal to said stud portion, said fastener providing a means for receiving a clamp of a jumper cable.

* * * * *

UNITED STATES PATENT AND TRADEMARK OFFICE

CERTIFICATE OF CORRECTION

PATENT NO. : 5,597,331

DATED : January 28, 1997

INVENTOR(S) : Patricia A. Gable, David J. Shroat and Jeffrey A. Stone

It is certified that error appears in the above-indentified patent and that said Letters Patent is hereby corrected as shown below:

ON THE TITLE PAGE:

Assignee: Ford Motor Company, Dearborn, Michigan
and
United Technologies Automotive, Inc., Dearborn, Michigan Signed and Sealed this Twenty-eighth Day of October, 1997

*Attest:*

Bruce Lehman

BRUCE LEHMAN

*Attesting Officer*

*Commissioner of Patents and Trademarks*